US005765747A

United States Patent [19]

Lawson

[11] Patent Number: 5,765,747

[45] Date of Patent: Jun. 16, 1998

[54] POUR SPOUT FITMENT FOR GABLE TOP CONTAINER

[75] Inventor: Richard A. Lawson, Midlothian, Va.

[73] Assignee: Westvaco Corporation, New York, N.Y.

[21] Appl. No.: 616,315

[22] Filed: Mar. 15, 1996

[51] Int. Cl.[6] ..... B65D 47/10

[52] U.S. Cl. ..... 229/125.15; 222/541; 229/125.04; 229/125.14

[58] Field of Search ..... 229/125.04, 125.14, 229/125.15; 220/465; 222/541, 548, 549, 551, 562

[56] References Cited

U.S. PATENT DOCUMENTS

| | | | |
|---|---|---|---|
| 2,400,716 | 5/1946 | Sattler | 229/125.15 |
| 3,119,543 | 1/1964 | Walker | 220/465 |
| 3,233,817 | 2/1966 | Casady | 220/465 |
| 4,560,085 | 12/1985 | Vom Hofe et al. | 220/465 |
| 4,669,640 | 6/1987 | Ando et al. | 222/541 |
| 4,948,015 | 8/1990 | Kawajiri et al. | 222/107 |
| 5,046,634 | 9/1991 | McFarlin et al. | 220/465 |
| 5,176,300 | 1/1993 | Kishikawa et al. | 222/541 |
| 5,176,313 | 1/1993 | Curry et al. | 229/125.15 |
| 5,632,440 | 5/1997 | Tragardh et al. | 229/125.15 |

FOREIGN PATENT DOCUMENTS

| | | | |
|---|---|---|---|
| 40/5051034 | 3/1993 | Japan | 229/125.15 |
| 92/16432 | 10/1992 | WIPO | 220/465 |

*Primary Examiner*—Gary E. Elkins

[57] ABSTRACT

A pour spout fitment is disclosed for inside installation through a pre-cut opening in one of the slanted roof panels of a gable top container. The fitment includes a spout base portion having inner and outer flanges which provide a recessed area therebetween wherein the size of the inner flange is greater than the size of the outer flange, the size and shape of the outer flange is substantially the same as the size and shape of the pre-cut opening, and the size of the recessed area is smaller than the size of the outer flange. The recessed area is adapted to capture protrusions located around the periphery of the pre-cut opening of the roof panel which extend inside the circumference of the pre-cut opening to temporarily retain the fitment in place until the inside flange of the base portion can be adhesively bonded to the inside of the roof panel.

3 Claims, 2 Drawing Sheets

POUR SPOUT FITMENT FOR GABLE TOP CONTAINER

BACKGROUND OF INVENTION

The present invention relates to paperboard containers and more particularly to the dispensing of liquid products from gable top paperboard containers. In the past, the long practiced method of discharging the liquid from a gable top container has been to tear open the sealed ridge of the gable top and pull out a foldable pour spout. This practice is objectionable because of the considerable manual effort involved, and also the hygienic problems arising from the direct manipulation of the pour spout panels from which the liquid is dispensed.

More recent gable top paperboard container constructions have employed a fitment type pour spout, e.g., a rigid pour spout usually formed of plastic and attached to one of the slanted panels of the gable top over a pre-cut opening. In such constructions, the spout is conventionally provided with a screw cap closure. For dispensing with this type of container, the user merely unscrews the cap, and after removing or puncturing an internal seal, pours the desired quantity of liquid from the container.

Examples of prior art pour spouts used for gable top containers include both exterior and interior fitments. An example of an exterior pour spout is shown in U.S. Pat. No. 4,964,562 wherein the flange of the pour spout is adhered to the outer barrier layer of the paperboard laminate with the use of heat and ultrasonic energy. Interior fitments are shown in U.S. Pat. Nos. 4,669,640 and 4,948,015. Interior pour spout fitments are inserted in the pre-cut openings of the gable top from within, where an inner flange portion of the fitment may be adhered to the inner barrier layer of the paperboard laminate with the use of heat and ultrasonic energy. Exterior pour spout fitments have the mechanical problem of being difficult to center over the pre-cut opening in the gable top when they are sealed to the gable top. Meanwhile, interior fitments suffer from the problem of not being retained in the pre-cut opening of the gable top before they can be sealed to the interior barrier layer of the paperboard laminate. One solution to this problem is taught by U.S. Pat. No. 5,176,300 (the '300 patent), wherein an interior fitment having only an interior flange is provided with a plurality of integral projections equally spaced around the outside of the fitment base portion. These projections are designed to correspond to the peripheral edge of the pre-cut opening in the gable top, and are located a distance from the fitment flange by an amount substantially equal to the thickness of the paperboard laminate. Thus in the '300 patent, the paperboard laminate material will become captured between the fitment flange and the plurality of projections when the fitment is inserted in the pre-cut opening of the gable top so as to hold the fitment in place as the container is moved from the fitment placement station to the sealing station during manufacture. However, the solution provided by the '300 patent is not completely reliable in use. Sometimes variations in the layer thicknesses of the barrier materials applied to the paperboard laminate will not allow the fitment to be retained in the opening with any reliability. In other cases, the projections are not properly sized for the pre-cut opening in the gable top which either allows the fitment to fall out of the pre-cut opening during handling, or prevents the fitment from being properly inserted in the pre-cut opening in the first place. Accordingly, the present invention is directed to an improvement in the method for installing inside pour spout fitments to paperboard containers and to solve the problems with the prior art type fitments.

SUMMARY OF INVENTION

According to the practice of the present invention, a novel means is disclosed for more reliably affixing an interior pour spout fitment to a paperboard container. The paperboard container is preferably constructed from a paper-board laminate comprising oxygen barrier layers and inner and outer layers of a heat-sealable material such as low density polyethylene (LDPE). The paperboard container is preferably of the gable top type, but may take another form such as a flat top container, and preferably includes a pre-cut opening for attaching the pour spout fitment. The pour spout fitment is provided with a base portion having both an interior flange and an exterior flange, to provide therebetween a continuous recessed area around the entire periphery of the fitment. The diameter of the interior flange is greater than the diameter of the outer flange, the diameter of the outer flange is substantially equal to the diameter of the pre-cut opening in the paperboard container, and the diameter of the recessed area in the fitment base portion is less than the diameter of the pre-cut opening. Meanwhile the pre-cut opening in the paperboard container includes a plurality of protrusions located around the periphery of the opening which extend inside the circumference of the opening where they may be captured within the peripheral recessed area of the fitment when the fitment is inserted in the pre-cut opening. This arrangement which alters the pre-cut opening rather than the fitment itself provides a more reliable scheme for retaining the pour spout fitment in place as the container is moved from the inserting station to the sealing station during manufacture.

DETAILED DESCRIPTION

Figure 1:
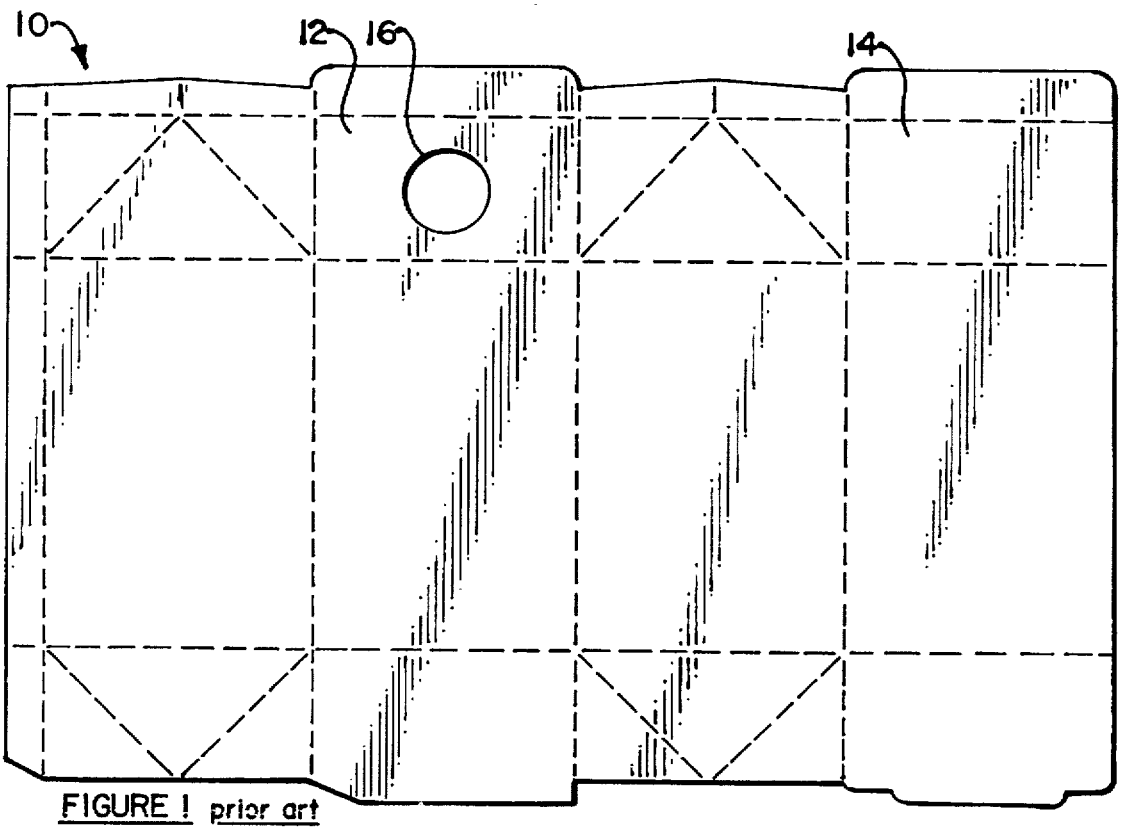
FIGURE 1 prior art
FIG. 1 is a plan view of a prior art gable top container blank showing a conventional pre-cut opening for a pour spout.

Referring now to FIG. 1 of the drawing, numeral 10 denotes an otherwise conventional paperboard blank used to make a gable top container. The paperboard blank is preferably coated with one or more barrier layers of polymeric material and is finished with inner and outer layers of a heat-sealable material such as low density polyethylene (LDPE). The blank 10 comprises a series of upper panels which includes slanted roof forming panels 12 and 14. One of these panels is provided with a conventional pre-cut opening 16 which defines the pour spout aperture for accepting either an inside or outside pour spout according to the prior art.

Figure 3:
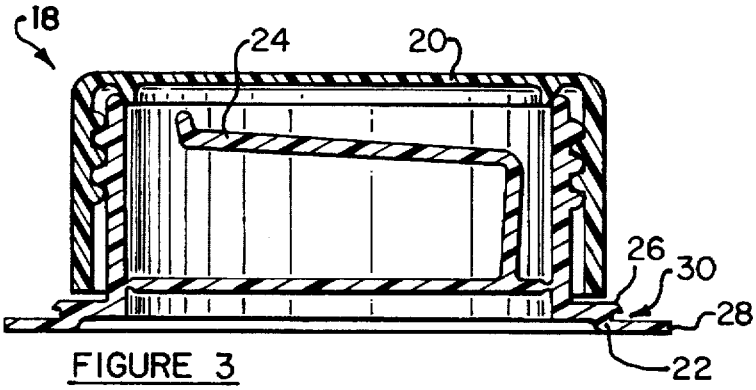
FIG. 3 is a cross sectional view of a pour spout structure useful for the modified pre-cut opening of the present invention; and, FIGS. 4–6 are partial plan views of the container blank of FIG. 2 with modifications to the pre-cut opening according to the present invention.

Referring now to FIG. 3 of the drawing, a cross section of a pour spout 18 that may be used in the present invention comprises a cap portion 20 and a base portion 22. If desired, the base portion 22 may also include a removable tamper evident inner seal 24. In addition, according to the present invention, the base portion 22 further includes an outer flange member 26 and an inner flange member 28. Both flanges 26 and 28 are preferably continuous around the periphery of the base member 22 and form therebetween a recessed area 30. The inner flange member 28 has a diameter that is larger than the diameter of the pre-cut opening 16 in the container blank and the outer flange member 26 has substantially the same diameter as the pre-cut opening 16. In practice, the surface of the outer flange 26 is shaped so that it will easily slip through the pre-cut opening 16 in the container blank 10 to bring the inner flange 28 into contact with the inner surface of the blank where it can be sealed in place. The recessed area 30 between the inner flange 28 and outer flange 26 is designed to capture the novel protrusions which are provided around the periphery of the pre-cut opening 16 according to the present invention.

Figure 2:
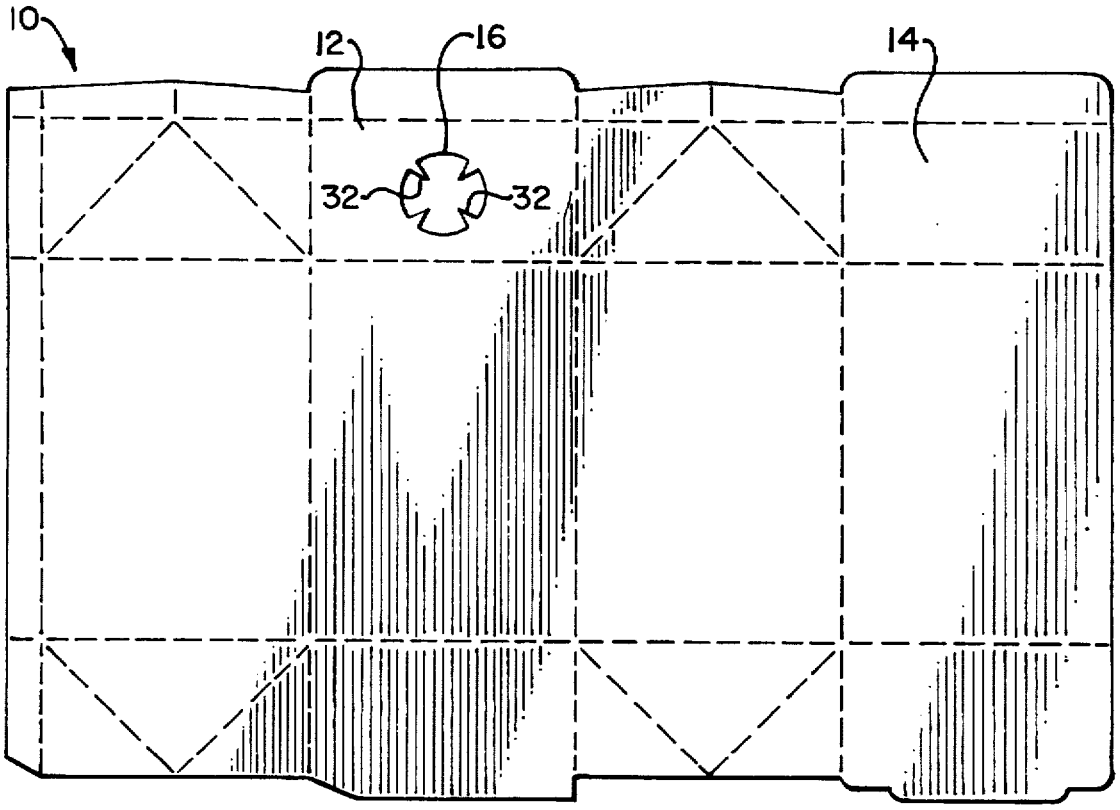
FIG. 2 is a plan view of the container blank of FIG. 1 showing a modified pre-cut opening for a pour spout according to the present invention.

FIG. 2 illustrates, as an example of the type of protrusions that might be used with the pour spout 18 of FIG. 3, a plurality of triangular shaped protrusions 32 formed from the paperboard laminate that extend inside the circumference of the pre-cut opening 16. The protrusions 32 are preferably located equidistant from one another in at least four different quadrants of the opening 16, however more or fewer protrusions may be utilized as desired. The protrusions are created when the pre-cut opening 16 is cut in one of the gable top panels 12 or 14 when the blank 10 is manufactured.

Figure 4:
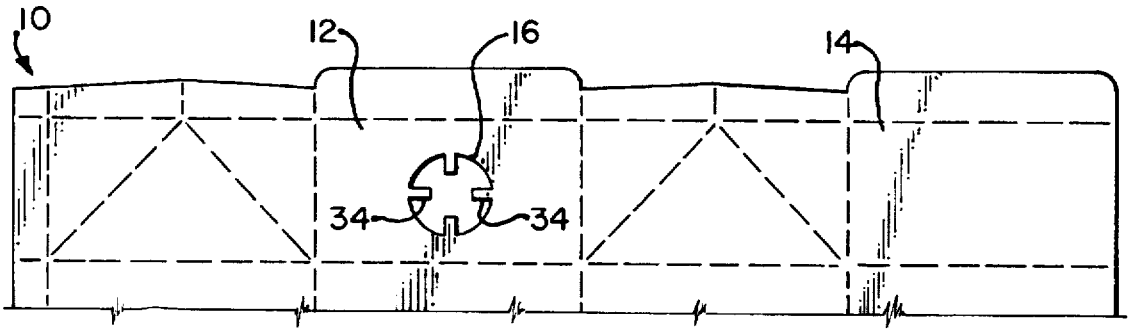

FIG. 4 illustrates another example of the container blank of the present invention wherein the protrusions around the periphery of the pre-cut opening 16 are in the shape of rectangles 34. These protrusions preferably extend inside the circumference of pre-cut opening 16 by an amount equal to about 5% of the diameter of the opening 16 and preferably between about 5–10% of the diameter of the opening. Thus for a typical pre-cut opening of about 30 mm, the protrusions would have a length of between about 1.5 and 3.0 mm.

Figure 5:
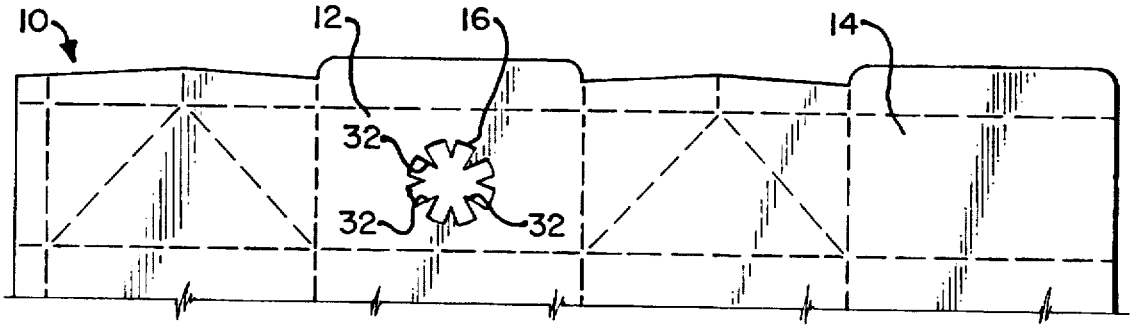
Figure 6:
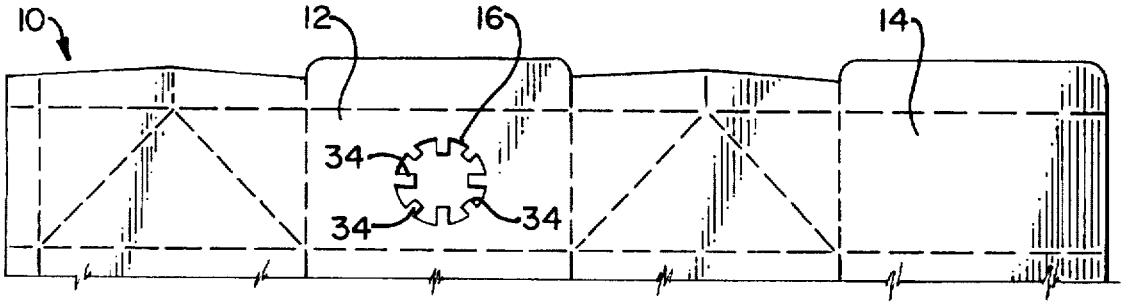

FIGS. 5 and 6 illustrate two other embodiments for the protrusions of the present invention wherein the number and size of the protrusions are varied.

Notwithstanding, the foregoing detailed disclosure, it will be understood that the preferred embodiments of the present invention set forth herein are by way of example only and are not intended to impose limitations on the invention in any way, as a variety of modifications or alterations of such embodiments will readily occur to one skilled in the art. For example, the pre-cut opening and pour spout need not be made circular as shown, but could be rectangular, oval shaped, triangular, or any other polygonal shape. Likewise, the protrusions which extend inside the circumference of the pre-cut opening may take any desired shape. Accordingly, what is desired to be protected are all modifications which fall within the scope of the appended claims.

What is claimed is:

1. A carton for containing a liquid product comprising a container body having an inside and an outside prepared from a paperboard material of predetermined thickness, a closed bottom and a gable top, said gable top comprising a pair of oppositely sloping side panels having inner and outer surfaces, one of said side panels having a pre-cut opening therein of predetermined diameter having a periphery, and a pour spout fitment inserted into said pre-cut opening from the inside of said container, said pour spout fitment comprising a base portion and a closure portion, said base portion including a pair of flanges of different diameters spaced apart from one another by a predetermined distance, said flanges comprising an inner flange which is adhered to the inner surface of the side panel having the pre-cut opening and an outer flange which is positioned on the exterior surface of the side panel having the pre-cut opening, said flanges defining therebetween a recessed area having a smaller diameter than the smallest diameter of said spaced apart flanges, the improvement wherein a plurality of protrusions of paperboard material are provided equally spaced around the periphery of said pre-cut opening which extend inside the periphery of said pre-cut opening by an amount equal to between about 5–10% of the diameter of said pre-cut opening and which are engaged within the recessed area of the pour spout base portion between the inner and outer flanges.

2. The carton of claim 1 wherein the diameter of the outer flange is substantially the same as the diameter of the pre-cut opening in the sloping side panel of said container body.

3. The carton of claim 2 wherein the distance between said spaced apart inner and outer flanges is substantially the same as the thickness of the paperboard material of the container body.

* * * * *